US007841083B2

(12) United States Patent
Alaux et al.

(10) Patent No.: US 7,841,083 B2
(45) Date of Patent: Nov. 30, 2010

(54) METHOD OF MANUFACTURING A TURBOMACHINE COMPONENT THAT INCLUDES COOLING AIR DISCHARGE ORIFICES

(75) Inventors: Thierry Henri Raymond Alaux, Yerres (FR); Patrick Emilien Paul Emile Huchin, Menucourt (FR); Patrice Jean-Marc Rosset, La Chapelle Gauthier (FR); Boris Soulalioux, Saint Martin la Plaine (FR)

(73) Assignee: SNECMA, Paris (FR)

( * ) Notice: Subject to any disclaimer, the term of this patent is extended or adjusted under 35 U.S.C. 154(b) by 940 days.

(21) Appl. No.: 11/668,198

(22) Filed: Jan. 29, 2007

(65) Prior Publication Data

US 2007/0175009 A1 Aug. 2, 2007

(30) Foreign Application Priority Data

Jan. 27, 2006 (FR) ..... 06 50292

(51) Int. Cl.
*B21K 25/00* (2006.01)

(52) U.S. Cl. ..... 29/889.2; 29/889.721

(58) Field of Classification Search ..... 29/889.2, 29/889.7, 889.71, 889.72, 889.721
See application file for complete search history.

(56) References Cited

U.S. PATENT DOCUMENTS

| | | | | |
|---|---|---|---|---|
| 3,596,703 | A * | 8/1971 | Bishop et al. | 164/132 |
| 3,957,104 | A * | 5/1976 | Terpay | 164/132 |
| 4,197,443 | A * | 4/1980 | Sidenstick | 219/69.15 |
| 5,243,759 | A * | 9/1993 | Brown et al. | 29/889.721 |
| 5,382,133 | A * | 1/1995 | Moore et al. | 415/115 |
| 7,036,556 | B2 * | 5/2006 | Caputo et al. | 164/369 |
| 7,144,220 | B2 * | 12/2006 | Marcin, Jr. | 416/97 A |
| 7,172,012 | B1 * | 2/2007 | Memmen | 164/45 |
| 7,520,312 | B2 * | 4/2009 | Memmen | 164/45 |

FOREIGN PATENT DOCUMENTS

| | | |
|---|---|---|
| EP | 1 616 642 A1 | 1/2006 |
| FR | 1.305.064 | 9/1962 |
| FR | 90.962 | 3/1968 |
| FR | 2 569 225 | 2/1986 |

* cited by examiner

*Primary Examiner*—David P Bryant
*Assistant Examiner*—Ryan J Walters
(74) *Attorney, Agent, or Firm*—Oblon, Spivak, McClelland, Maier & Neustadt, L.L.P.

(57) ABSTRACT

A method of producing cooling fluid discharge orifices in the wall of a part manufactured by the technique of lost wax casting in which a pattern of the part is produced in a wax mold, the orifices each having a first portion emerging at the external surface of the wall is disclosed. The method includes making cavities in the wax pattern that correspond to the first portions of said orifices of the part. Thus, it is possible to produce cooling air discharge orifices without sharp edges.

11 Claims, 3 Drawing Sheets

METHOD OF MANUFACTURING A TURBOMACHINE COMPONENT THAT INCLUDES COOLING AIR DISCHARGE ORIFICES

The present invention relates to the cooling of turbomachine components by an air film.

BACKGROUND OF THE INVENTION

To increase the performance of a gas turbine engine, it is necessary to increase the temperature of the gases leaving the combustion chamber. The components of the engine bathed by these gases are therefore subjected to high thermomechanical stresses. They are protected by making cooling air drawn off from the compressor flow into channels provided beneath the wall and discharging said air into the gas stream via small-diameter orifices that are made so as to form a film of protective gas between the wall and the flow of hot gas. The components affected by this treatment are essentially the distributor sectors, consisting of one or more radial airfoils between two platforms in ring sectors by which the gas stream is bounded, and also the moving blades of the first turbine stages. The mechanical behavior and the lifetime of the components are improved by this means.

DESCRIPTION OF THE PRIOR ART

The orifices are generally bores of cylindrical shape, made in the appropriate regions in the wall to be protected. To improve the formation of the air film along the wall, the bores are given a flared shape at its surface. These holes therefore consist of two separate parts namely a cylindrical part metering the airflow and a shaped part so as to diffuse and orient the airflow in order to promote flow in the cooling film formation region. Examples of such orifices are illustrated in patents U.S. Pat. No. 6,183,199, EP 228 338 and U.S. Pat. No. 4,197,443.

One known method of manufacture consists in producing these bores in two stages. Firstly, the flared part of the orifice is machined by EDM (electrical discharge machining) and then the bottom of the orifice is drilled, for example by a laser beam, in order to produce a cylindrical channel.

In the EDM technique, an electrode is placed at a certain distance from the surface to be eroded and electrical discharges are produced between it and the workplace. These discharges carry away particles of material and progressively erode the surface of the workplace. The shape of the cavity obtained depends on the geometry of the electrode, which may be frustoconical, for example with a rectangular cross section, or more complex with rounded portions, as may be seen in document U.S. Pat. No. 6,183,199 or document EP 228 338. The second, calibrated, part is produced either with the same electrode or by means of a laser beam.

The following problems with this technique are encountered

The electrode, whatever its shape, even if it allows rounded wall portions to be produced inside the cavity, cannot prevent sharp edges remaining. These edges are the site of stress concentrations and run the risk of being crack initiators.

For mainly economic reasons, the orifices are mass-produced by means of electrodes which are cut in a plate and are therefore arranged in a row. Such a practice does not allow the geometry of the orifices to be individually optimized according to the local profile surrounding them.

It is not possible to produce this type of orifice in regions of reduced access. This is especially the case when having to produce bores along the airfoils of a bi-airfoil distributor sector in the inter-blade channel. Since the flared shape of the orifices in this region is absolutely necessary it is therefore not possible to produce bi-airfoil distributor sectors by casting as a single component. Each blade is manufactured separately and the blades are then welded together to form the distributor sector. The manufacturing cost is therefore higher.

SUMMARY OF THE INVENTION

According to the invention, these problems are solved with a method of producing cooling fluid discharge orifices in the wall of a part manufactured by the technique of lost wax casting in which a pattern of the part is produced in a wax mold, and said orifices of which have a first portion emerging at the external surface of the wall. This method is characterized in that it consists in making cavities in the wax pattern that correspond to the first portions of said orifices.

Preferably protuberances with a shape complementary to that of said first portions are made in the wax mold in such a way that the pattern has said cavities and that the part as cast includes said preformed first portions.

By producing this orifice portion on the wax pattern of the part, in such a way that it is formed by casting, this shape can be easily optimized for each emission on the profile of the stream. Complicated and expensive use of the electrical discharge machining technique is avoided and such a method is compatible with the manufacture of multiple airfoil distributor sectors by casting.

Most often, said first portion has a flared shape, but the method of the invention allows any type of shape. Preferably, the joining regions between two noncoplanar surface portions of the protuberances have a curbed profile so as to avoid forming sharp edges. They are said to be "radiused". The radius or radii of curvature of the radiused surfaces is or are at least 0.1 mm, preferably 0.2 mm. Optionally, the curvature of these surfaces is progressive.

According to another feature a second orifice portion, is machined in the part as cast bringing the bottom of the first portion into communication with the internal surface of the wall. The cross section of this second orifice portion is advantageously calibrated so as to meter the airflow. This portion is of tubular shape with a circular or other, especially oblong, cross section, for example in the form of a slant.

According to a preferred method, the machining is carried out by means of a laser beam, but other means may be employed.

The invention also covers the turbomachine component obtained according to the method and including cooling air discharge orifices of which the regions where the first portions join with the external wall of the component are radiused.

BRIEF DESCRIPTION OF THE DRAWINGS

The invention will now be described in greater detail in relation to a non limiting embodiment illustrated in the appended drawings, in which:

FIG. 1 shows a moving blade 1, comprising a root 3, a platform 5 and an airfoil 7. The blade is mounted via the root in a suitable housing on the rim of a turbine disk. When the blade is of the cooled type, it is hollow and has cavities designed to circulate cooling air. A fraction of this air is directed through the wall of the blade via calibrated orifices. Some 9 of these orifices are of simple tubular shape. Other orifices 10 include a flared portion so as to direct the air along the wall and allow a protective film to be formed on it. These orifices 10 with a downstreamly flared portion are for example placed along the leading edge of the airfoil on the suction side at 10*a* or else along a generally radial line on the pressure side of the airfoil at 10*b*. Another example of a row of orifices having a flared portion lies along the trailing edge on the pressure side at 10*c*.

FIG. 2 shows a sectional view on the plane II-II of the wall 71 of the airfoil through an orifice 10. A distinction may be made between a flared first portion 10E emerging on the external surface of the wall 71 and a tubular portion 10T. The cross section of this portion 10T determines the flow rate of cooling air through the orifice. The jet of air spreads out laterally in the flared part 10E and forms, together with the other adjacent jets, a film along the wall of the airfoil.

Owing to the complexity of its geometry and the thermo-mechanical stresses that it has to withstand, this type of part is manufactured by lost wax casting. The reader is reminded below of this known technique A pattern made of wax or another equivalent material is first produced, this pattern including a casting core corresponding to the internal cavities of the blade. This core itself is manufactured separately and generally has a complex shape consisting of several elementary cores. This core is placed in a wax mold and wax is injected into the space left between the core and the internal wall of the mold. What is obtained is the pattern incorporating the core, which is a replica of the component to be cast.

Figure 3:
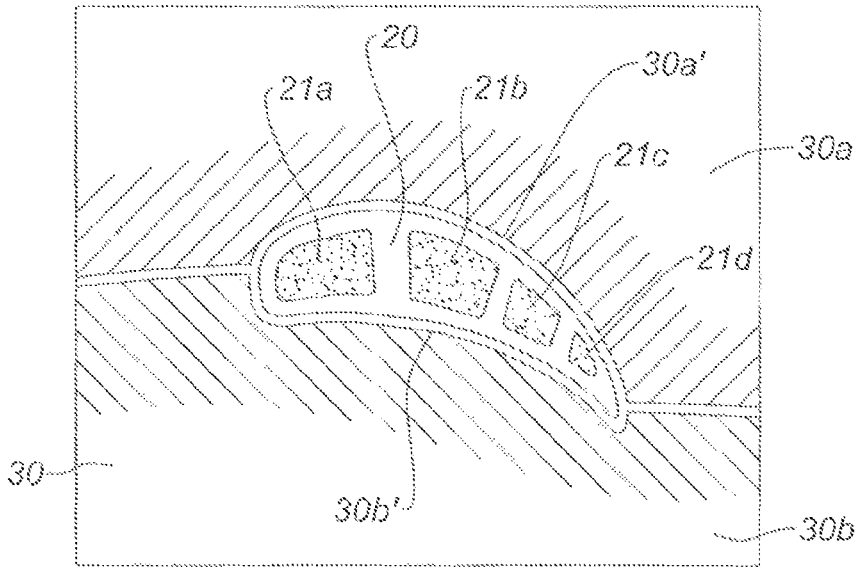
Fig. 3 BACKGROUND ART
FIG. 3 shows, in section, a casting pattern in its wax mold.

An example of a component, here a turbine blade, is shown in FIG. 3. The wax pattern 20 incorporates a core comprising several ceramic core elements 21*a* to 21*d*. The wax mold 30 here consists of two parts 30*a* and 30*b*, each with a molding wall 30*a*' and 30*b*' corresponding to the envelope of the component. The mold of the example shown has a simple shape, but it may comprise many elements depending on the complexity of the component.

The wax pattern 20 is then extracted from the mold 30 and dipped into slips consisting of suspensions of ceramic particles, in order to coat it with successive slip layers and to form a shell mold. After the mold has been hardened by firing, the wax is removed. The component is obtained by pouring a molten metal, which occupies the voids between the internal wall of the mold and the core. By using a seed or an appropriate selector, and controlled cooling, the metal solidifies in a predetermined structure. Depending on the nature of the alloy and the expected properties of the component resulting from the casting operation, directional solidification with a columnar structure, directional solidification with a single-crystal structure or equiaxed solidification respectively may take place. The first two families of components relate to superalloys for components exposed to high stresses, both thermal and mechanical, in the turbojet engine, such as the HP turbine blades.

Figure 1:
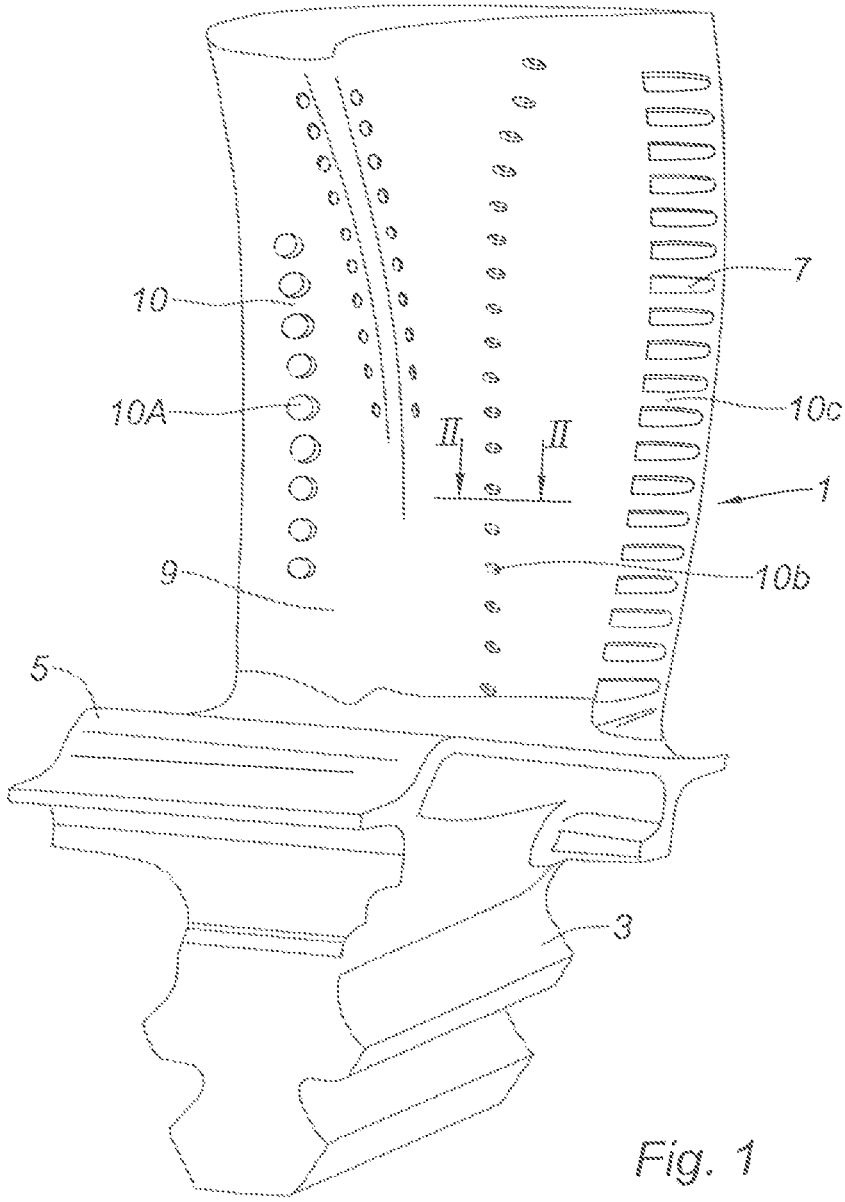
Fig. 1 BACKGROUND ART
FIG. 1 shows a cooled moving blade of a turbine.
Figure 2:
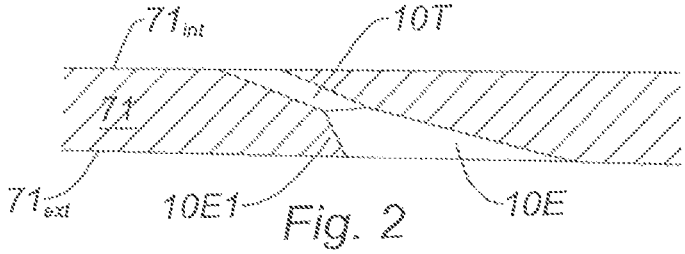
Fig. 2 BACKGROUND ART
FIG. 2 shows a sectional view of the wall at a cooling air discharge orifice according to the prior art.

According to the prior art technique, the flared holes are formed by machining the part as cast. The orifice shown in FIG. 2 is obtained by EDM machining. In particular, this figure shows that the joining region between the surface $\mathbf{71}_{ext}$ and the flared hole 10E has a sharp edge 10E1 that is impossible to avoid. Machining this part would at best result in the formation of a chamfer but not in a fillet, in particular because of the small dimension of this type of orifice. The machining tolerances would not allow the tool to be positioned sufficiently precisely with respect to the region to be machined.

DESCRIPTION OF THE PREFERRED EMBODIMENTS

According to the invention, it is proposed to produce said first, flared, portion of the orifices directly in the wax pattern. Preferably, the wax mold into which the wax is injected has the impression of the first portions of the orifices.

Figure 4:
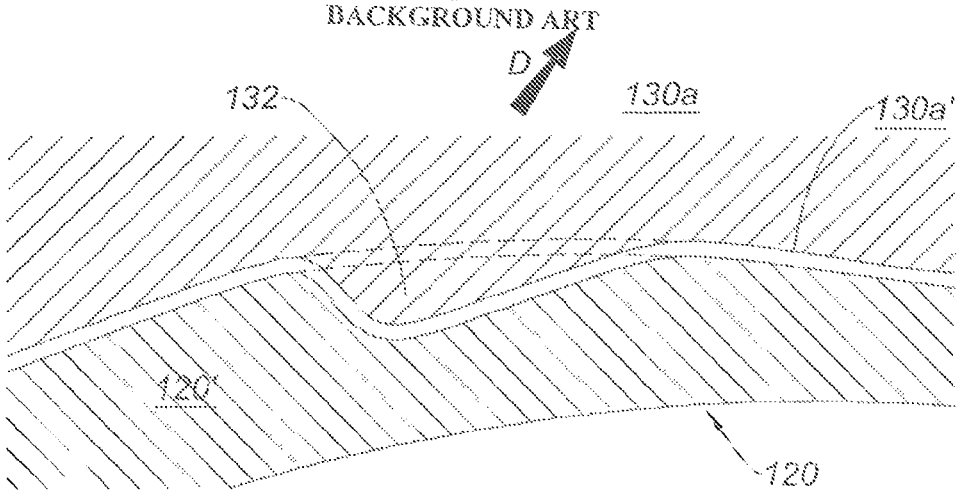
FIGS. 4 to 6 show the steps in producing flared holes according to the invention.

FIG. 4 shows a sectional view at the internal surface 130*a*' of the mold 130*a* and the pattern through a protuberance 132 for molding a first portion according to the invention. The elements of the invention that correspond to those of the prior art have the same reference but increased by 100. The protuberance 132 has the shape of the first portion that it is desired to impress in the wall 120' of the wax pattern 120. To meet the demolding constraints, the faces of the protuberance do not include a part making an angle below a limiting demolding angle relative to the direction of demolding in this region, shown by the arrow D. When the mold consists of a plurality of elements with a specific insert for the protuberance or a group of protuberances, it is sufficient for the angle to be defined relative to the direction of extraction of this insert. The use of an insert has the additional advantage of making it easier to modify the profile of the protuberances, for example during a component development phase. It is sufficient to change just the insert in order to manufacture a component with the new profile of the flared openings.

Figure 5:
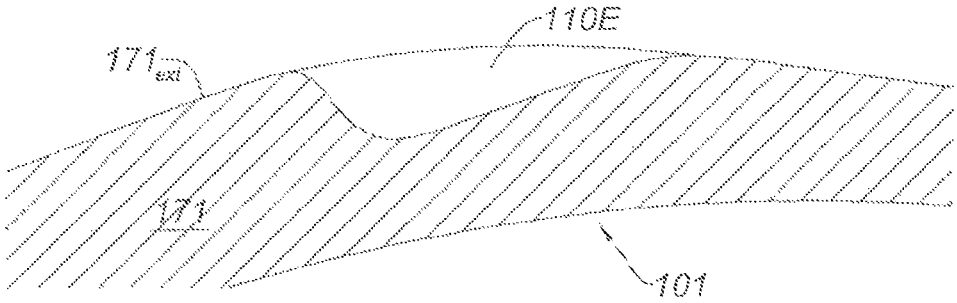
Figure 6:
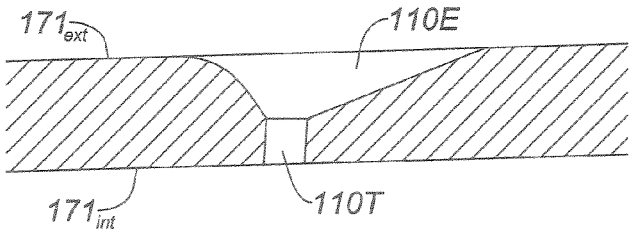

The part 101 as cast has, in its wall 171, a cavity 110E corresponding to the shape of the protuberance 132 that was applied in the wall 120' of the wax pattern 120. This cavity 110E constitutes the first portion of the orifice that it is desired to cut into the wall 120'. The formation of the cooling air discharge orifices is completed by drilling the bottom of the cavity 110E, for example with a laser beam. This drilling forms a tubular channel 110T. The cross section of this channel 110T is determined by the desired air flow rate and its shape may advantageously be circular or oblong. These two steps are illustrated by FIGS. 5 and 6.

Figure 7:
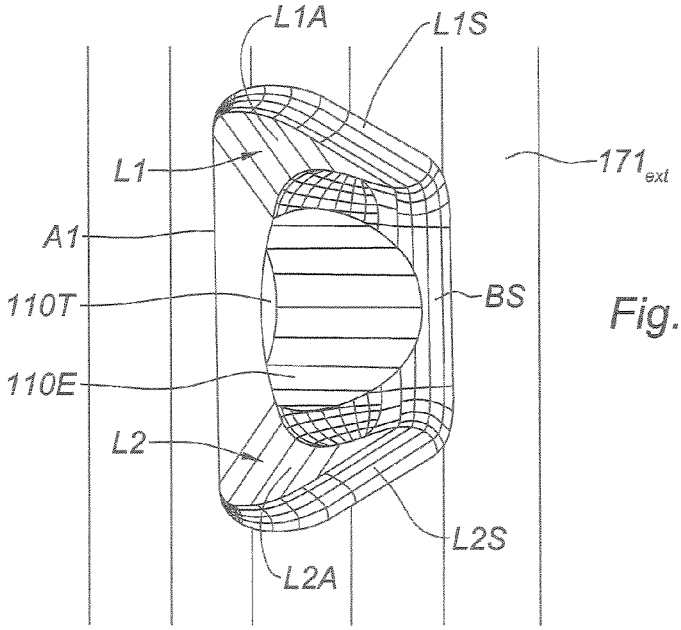
FIGS. 7 and 8 show perspective views of a flared orifice according to the invention.
Figure 8:
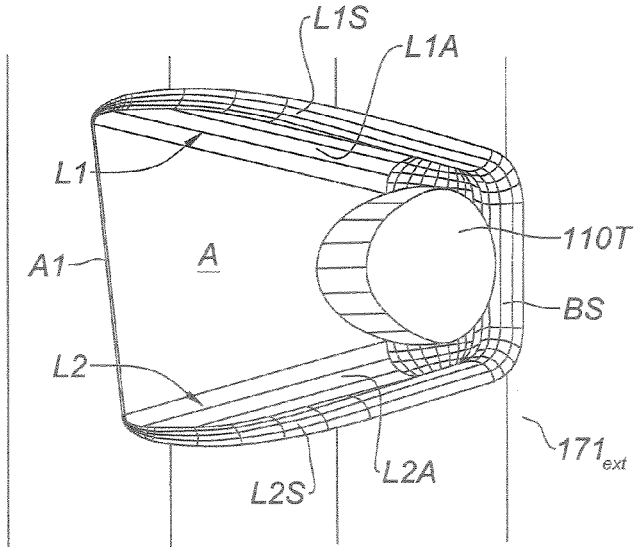

FIGS. 7 and 8 show a cooling air discharge orifice 110 that can be obtained using the method of the invention in a wall 171 that has to be cooled by an air film. The various surface portions are shown with directrix generatrix segments so as to illustrate their three-dimensional character.

They show the first portion 110E, of flared shape, emerging at the external surface $\mathbf{171}_{ext}$ of the wall 171. A second portion 110T, which is tubular, is machined in the bottom of the first portion and emerges at the internal surface $\mathbf{171}_{int}$ of the wall 171. The cavity 110E has a bottom A, a substantially trapezoidal shape when seen from above. The cavity is directed downstream relative to the direction of low of the gases. This bottom is inclined between the tubular portion 110T and the edge A1 where it joins the external surface $\mathbf{171}_{ext}$ of the wall 171. The sidewalls L1 and L2 of the cavity are inwardly curved in the form of concave cylindrical sectors L1A and L2A, here with a progressive profile, along the region where they join with the bottom A. The surfaces are radiused surfaces. The radius of curvature of these surfaces is advantageously at least 0.1 mm and varies along the profile. The sidewalls L1 and L2 also include inwardly curved surface portions L1S and L2S, with a progressive profile, directed along the surface of the wall $\mathbf{171}_{ext}$. The sidewall B of the cavity located transversely between the two lateral sidewalls L1 and L2 also includes a convex radiused part BS for joining with the external surface $171_{ext}$ of the wall 171 and concave radiused portions with the sidewalls L1 and L2.

These radiused surface portions L1S L2S and BS are complementary to the surfaces of the protuberances 132 that join with the surface 130*a*' of the wax mold 130*a* in which the pattern is molded. All that is required is to shape the protuberances correctly so as to obtain a component with no sharp edge at these points.

These radiused joining portions have for example a radius of curvature of 0.2 mm, with a minimum of 0.1 mm. They limit the thermal and mechanical stresses in these regions and reduce the occurrence of crack initiators. The mechanical behavior of the component and its lifetime are thus generally improved.

Another advantage over EDM machining is that surfaces are obtained having a low roughness, which is aerodynamically favorable. For example, the roughness $R_a$ obtained by EDM is typically 4.5 μm—to obtain a lower value is very expensive. A finer surface finish is easily obtained by the casting method, with an $R_a$ of 1.2 μm for example.

It should be noted that the line of intersection of the tubular region 110T with the bottom of the first portion 110E is not radiused as it is obtained by machining.

What is claimed is:

1. A method of producing cooling fluid discharge orifices in a wall of a part manufactured by lost wax casting in which a pattern of the part is produced in a wax mold, the orifices each having a first portion emerging at an external surface of the wall, wherein the part is a turbomachine component, which method comprising:

making cavities in the wax pattern that correspond to the first portions of said orifices on the external surface of the wall of the part;

casting the part by lost wax casting thereby forming the first portions of the orifices on the external wall of the part such that the first portions of the orifices are not in communication with an internal surface of the wall; and machining, in the part as cast, a second orifice portion that brings a bottom of the first orifice portion into communication with the internal surface of the wall.

2. The method as claimed in claim 1, wherein protuberances with a shape complementary to that of said first portions are made in the wax mold in such a way that the pattern includes said cavities and the part as cast includes said first portions of the orifices.

3. The method as claimed in claim 2, wherein the cavities corresponding to said first portions of the orifices are of flared shape.

4. The method as claimed in claim 2, wherein the protuberances are radiused.

5. The method as claimed in claim 1, wherein joining regions, at least partly, provided in the cavities corresponding to said first portions of the orifices, are radiused.

6. The method as claimed in claim 5, wherein the joining region between side walls of the cavities corresponding to said first portions of the orifices and an external surface of the pattern is radiused.

7. The method as claimed in claim 5, wherein a radius or radii of curvature of radiused surfaces is or are at least 0.1 mm, the radius of curvature along the profile of the radius surfaces being progressive.

8. The method as claimed in claim 7, wherein the radius or radii of curvature of the radiused surfaces is or are 0.2 mm.

9. The method as claimed in claim 1, wherein the second orifice portion is of tubular shape.

10. The method as claimed in claim 9, wherein the machining is carried out by a laser beam or EDM.

11. The method as claimed in claim 1, wherein the bottom of the first orifice portion is substantially trapezoidal when viewed from above.

* * * * *